United States Patent [19]

Kurtz et al.

[11] 4,057,474

[45] Nov. 8, 1977

[54] ELECTROLYTIC PRODUCTION OF ALKALI METAL HYDROXIDE

[75] Inventors: Bruce E. Kurtz, Marcellus, N.Y.; Joel P. Guptill, Griffith, Ind.; Robert H. Fitch, Syracuse, N.Y.

[73] Assignee: Allied Chemical Corporation, Morris Township, N.J.

[21] Appl. No.: 699,767

[22] Filed: June 25, 1976

[51] Int. Cl.[2] ..... C25B 1/14; C25C 7/00

[52] U.S. Cl. ..... 204/98; 204/255; 204/257

[58] Field of Search ..... 204/98, 257, 255

[56] References Cited

U.S. PATENT DOCUMENTS

| | | | |
|---|---|---|---|
| 3,899,403 | 8/1975 | Cook et al. | 204/98 |
| 3,963,592 | 6/1976 | Lindstrom | 204/98 |

FOREIGN PATENT DOCUMENTS

| | | |
|---|---|---|
| 2,437,783 | 3/1976 | Germany. |

*Primary Examiner*—Leland A. Sebastian

*Attorney, Agent, or Firm*—Gerhard H. Fuchs; Anthony J. Stewart

[57] ABSTRACT

In the process of making aqueous alkali metal hydroxide solution and diatomic halide gas by electrolysis of aqueous alkali metal halide solution in a bank of cationic permselective membrane cells, current efficiency is improved and/or concentration of the alkali metal hydroxide solution product is increased by feeding water to the cathode compartment of the first cell and then transferring the catholyte serially from cell to cell at incrementally increasing alkali metal hydroxide concentration, and withdrawing alkali metal hydroxide product solution from the last cell of the bank.

15 Claims, 7 Drawing Figures

ELECTROLYTIC PRODUCTION OF ALKALI METAL HYDROXIDE

BACKGROUND OF THE INVENTION

The present invention relates to an improvement in the process and apparatus for making diatomic halogen gas and alkali metal hydroxide by electrolysis of an aqueous alkali metal halide solution employing a bank of two or more cationic permselective membrane cells.

Cationic permselective membrane cells for electrolysis of aqueous alkali metal halide solution to form alkali metal hydroxide and diatomic halide gas are comprised of a housing; an anode and a cathode located within the housing; a cationic permselective membrane separating the anode and the cathode and dividing the housing into an anode compartment and a cathode compartment. In operation, an aqueous alkali metal halide solution is fed to the anode compartment, and water or aqueous alkali metal hydroxide solution is fed to the cathode compartment. A direct electric current is made to flow from the cathode to the anode. It is the primary function of the cationic permselective membrane to permit passage only of positively charged alkali metal ions from the anode compartment to the cathode compartment; negatively charged ions are substantially inhibited from passing through the membrane, as a consequence of the nature of the membrane.

In operation of the cell, as current flows from the cathode to the anode, diatomic halogen gas is formed on the surface of the anode:

$$2Hal^- \rightarrow Hal_2 + 2e^-$$

Alkali metal cations pass through the membrane from the anode compartment to the cathode compartment under the influence of the electrical field, because the positively charged alkali metal cations are attracted by the negatively charged cathode and are repelled by the positively charged anode. A certain amount of endosmotic water is transferred through the membrane from the anode compartment to the cathode compartment. On the surface of the cathode, water is decomposed into hydrogen gas and hydroxide ions:

$$2e^- + 2H_2O \rightarrow H_2 + 2OH^-$$

Gas bubbles forming on the surface of the electrodes—diatomic halogen gas at the anode, hydrogen gas at the cathode—tend to inhibit current flow, raising overall electrical resistance of the cell. Also, depletion of the alkali metal halide, resulting in dilution of the brine (anolyte) in the anode compartment, further increases the resistance within the cell. To minimize cell resistance caused by build-up of gas bubbles on the surface of the electrodes and by dilute electrolyte, it is common practice to circulate the aqueous alkali metal halide solution through the anode compartment at a relatively high rate, so that only between about 5 and 30 percent of the alkali metal halide contained in the brine fed to the anode compartment is actually decomposed as the brine is passed therethrough. High rate of recirculation of the anolyte feed results in turbulence of the anolyte within the anode compartment, causing the halogen gas bubbles to disengage more readily from the surface of the anode, thereby lowering the electrical resistance of the cell.

However, there is only relatively limited mass flow through the membrane, relative to the anolyte feed flow rate, as a consequence of migration of alkali metal cations and endosmotic water through the membrane. In order to produce alkali metal hydroxide solution of the proper concentration, it is usual practice to feed water directly to the cathode compartment to supplement the endosmotic water flow associated with the alkali metal cations. Feeding water to the cathode compartment provides means for controlling the alkali metal hydroxide concentration of the catholyte withdrawn from the cell at any desired concentration, within the range of up to about 50 percent by weight of alkali metal hydroxide, based on the combined weight of the water and alkali metal hydroxide.

In the process for electrolysis of aqueous alkali metal halide solutions, high current efficiency is a much sought goal because efficient utilization of energy results in lower product costs. In cationic permselective membrane cells, current efficiency is reduced by back-migration of hydroxide ions through the membrane from the cathode compartment to the anode compartment. The extent of this back-migration depends on many factors, such as composition and treatment of the membrane; operating conditions within the cell such as temperatures, current densities, spacing of electrodes in relation to the membrane; as well as the ion concentration within the anolyte and catholyte. Back-migration tends to be very much increased with increasing hydroxide ion concentration in the catholyte.

Back-migration occurs because the negatively charged hydroxide ions present in the catholyte are attracted to the positively charged anode and are repelled by the negatively charged cathode. Under the influence of the electric potential field in the cell, the hydroxide ions have a relatively strong tendency to back-migrate. Conversely, however, halide ions have little tendency to migrate from the anode compartment to the cathode compartment since, under the influence of the electric potential field, the negatively charged halide ions will move in the direction of the positively charged anode, and are actually repelled by the negatively charged cathode. This factor, combined with the cationic permselective properties of the membrane, results in very little migration of halide ion through the membrane. Consequently, alkali metal hydroxide solutions obtained in permselective membrane cells are usually low in halide ions.

Back-migration of hydroxide ions results in reaction of hydroxide ions at the anode surface to produce oxygen gas, according to the following equation:

$$4OH^- \rightarrow O_2 + 2H_2O + 4e^-$$

A side reaction that results from back-migration of hydroxide ions in chlorine/alkali metal hydroxide electrolytic membrane cells is the reaction of hydroxide ions with dissolved chlorine gas to form hypochlorous acid. The hypochlorous acid thus formed is relatively unstable, and reacts further to form chlorates. These reactions are illustrated by the following equations:

$$Cl_2 + OH^- \rightarrow Cl^- + HOCl$$

$$HOCl \rightarrow H^+ + OCl^-$$

$$2HOCl + OCl^- \rightarrow ClO^-_3 + 2Cl^- + 2H^+$$

As a result of these side reactions electrical current is consumed in the formation of products other than diatomic halogen gas and alkali metal hydroxide.

It is an object of the present invention to provide an improvement in the operation of cationic permselective membrane cells for electrolysis of aqueous alkali metal hydroxide solution to form alkali metal hydroxide and diatomic halide gas offering improved current efficiency, and to provide apparatus for practicing such method.

It is a further object of the present invention to provide an improvement in the apparatus for and operation of cationic permselective membrane cells for electrolysis of aqueous alkali metal halide solutions to permit production of alkali metal hydroxide solution of high concentration at improved current efficiency.

SUMMARY OF THE PRESENT INVENTION

It has now been discovered that in the operation of a bank of cationic permselective membrane cells for electrolysis of aqueous alkali metal halide solutions, backmigration of hydroxide ions from the cathode compartment to the anode compartment is reduced by employing sereis catholyte flow, as may, for example, be accomplished by feeding water or weak alkali metal hydroxide solution to the cathode compartment of the first cell in the bank and then transferring the catholyte serially from the cathode compartment of a preceeding cell to the cathode compartment of a succeeding cell in the bank, and withdrawing alkali metal hydroxide solution from the cathode compartment of one or more succeeding cells in the bank.

For purposes of the present invention, a bank of cationic permselective membrane cells for electrolysis of aqueous alkali metal halide solution to form alkali metal hydroxide and diatomic halide gas is defined as an arrangement of a plurality of permselective membrane cells functionally interconnected as by common bus bars or intercell connections for feeding electrical current, and/or by common headers or lines for feeding raw materials to each individual cell in the bank, and/or by common headers or lines for withdrawing gaseous and/or liquid reaction products.

In accordance with the present invention, there is provided in a bank of a plurality of cationic permselective membrane cells for electrolysis of aqueous alkali metal halide solution to form alkali metal hydroxide and diatomic halide gas, each cell comprising: a housing; an anode and a cathode located within the housing; a cationic permselective membrane separating the anode and the cathode and dividing the housing into an anode compartment and a cathode compartment; means for feeding enriched and for withdrawing partially depleted aqueous alkali metal halide solution to and from the anode compartment of each cell in the bank; means for feeding water or weak alkali metal hydroxide solution to the cathode compartment and for withdrawing aqueous alkali metal hydroxide solution from the cathode compartment of each cell in the bank; the improvement which comprises means for transferring catholyte serially from the cathode compartment of one or more preceeding cells to the cathode compartment of one or more succeeding cells in the bank.

In accordance with the present invention, there is further provided an improvement in the process of making aqueous alkali metal hydroxide solution and diatomic halide gas by electrolysis of aqueous alkali metal halide solution in a bank of a plurality of cationic permselective membrane cells, involving feeding enriched and withdrawing partially depleted aqueous alkali metal halide solution to and from the anode compartment of each cell, and feeding water or weak alkali metal hydroxide solution to and withdrawing catholyte comprising aqueous alkali metal hydroxide solution from the cathode compartment of each cell, the improvement which comprises transferring catholyte serially from the cathode compartment of one or more preceeding cells to the cathode compartment of one or more succeeding cells in the bank.

Current efficiency as used herein denotes the fraction, expressed as percent by weight, of the amount of alkali metal hydroxide actually produced in a cell or a bank of a plurality of cells, divided by the theoretical amount of alkali metal hydroxide that should have been produced in the cell or the bank of cells for a given amount of electrical current actually passed therethrough.

Just as there are factors which cause the actual current drawn by a cell to exceed the current theoretically corresponding to the amount of product actually produced, some of which have been discussed above, there are factors which cause the voltage requirement to exceed the theoretical decomposition voltage for the anode and cathode reactions. The voltage efficiency of the cell is the theoretical decomposition voltage for the desired overall reaction, divided by the actual voltage across the cell, expressed as percent.

For example, for a cell for electrolysis of aqueous sodium chloride to form sodium hydroxide, chlorine and hydrogen, the actual voltage across a cell is determined by the following relationship:

$$E = E_o + \frac{RT}{F} \ln \frac{{}^{a}NaOH^2\, {}^{a}Cl_2\, {}^{a}H_2}{{}^{a}NaCl^2\, {}^{a}H_2O^2} + kI$$

wherein "$E_o$" is the theoretical decomposition voltage (2.3 volts in the case of NaCl), "RT/F" is a factor variable only with the temperature of the electrolyte (T), "*a*" denotes the activities (concentrations times the activity coefficients) of the products and the reactants, and "*k*" is the sum of all the ohmic resistances in the cell, that is of all the resistances which are at least approximately proportional to the current, "I".

A typical cell for electrolysis of sodium chloride solution, whether diaphragm cell or permselective membrane cell, may operate at a total voltage of about 4 volts. The difference between this practical operating voltage and the theoretical decomposition voltage resides in the last two terms of the above equation. The activity term (the term in the middle of the right hand side of the above equation) reflects the effect of product and reactant concentrations. The last term includes the electrical resistance across the electrolyte and the membrane separating the electrodes, the resistance through the electrodes, and the resistance through electrode connections. For the sake of convenience, one may also include herein the effect of electrode polarization due to, for example, accumulation of evolved gas on the surface on the electrodes and local concentration gradients.

The overall efficiency with which a cell converts electrical energy to useful products is measured by the power efficiency, which is simply the product of the current and the voltage efficiencies.

In order to reduce the expense of subsequent evaporation of the alkali metal hydroxide solution as obtained from the electrolysis process to obtain more concentrated solution containing in the order of about 50 percent alkali metal hydroxide, the usual form in which such solutions are sold, it would be desirable to operate the cells with the highest possible hydroxide ion concentration in the cathode compartment. However, with increasing hydroxide ion concentration the current efficiency is reduced due to increased back-migration of hydroxide ion. Increasing hydroxide ion concentration also tends to decrease the voltage efficiency (due to the influence of the product and reactant activity term in above equation), although this effect is reduced by the concurrent decrease in the electrical resistance of the catholyte, thus reducing the contribution of the ohmic term to the total voltage.

While it is true that a higher cell current efficiency as well as, perhaps, higher voltage efficiency can be achieved by by maintaining a lower overall hydroxide ion concentration in the sum total catholyte compartments of a bank of permselective membrane cells, it has been found that the influence of changes in the current efficiency becomes far more significant than the influence of changes in the cell voltage which occur in response to changes in the catholyte hydroxide ion concentration. Under these circumstances, total cell operating efficiency, which is the power efficiency, will be determined predominantly by the current efficiency. By employing series catholyte flow in accordance with the present invention, which permits maintaining a lower overall hydroxide ion concentration in the sum total catholyte compartments of a bank of permselective membrane cells, it has been found that one can achieve a higher overall power efficiency without sacrifice in ultimate concentration of alkali metal hydroxide in the product.

Series catholyte flow in accordance with the present invention may also be employed between different and physically separate individual cells (which then become a bank of cells as herein defined by reason of employment of series catholyte flow) as well as between different banks of permselective membrane cells wherein each bank of cells is an assembly or group of two or more cells employing parallel catholyte and anolyte flow. All the reasons previously stated for the advantages gained by employing series catholyte flow between individual cells of a cell assembly equally apply to employment of series catholyte flow between individual banks of cells within an assembly of two or more banks of cells.

BRIEF DESCRIPTION OF THE DRAWINGS

In the drawings,

FIGS. 1 and 2 each illustrate a bank of three permselective membrane cells employing parallel anolyte flow and series catholyte flow. In the embodiment illustrated by FIG. 1, transfer of the catholyte serially from cell to cell is effected by means of pumps; in the embodiment illustrated by FIG. 2, transfer of catholyte serially from cell to cell is effected by means of gravity flow.

FIG. 3 illustrates use of series catholyte flow in a bank of six permselective membrane cells employing parallel anolyte flow throughout, employing series catholyte flow in blocks of two cells each.

FIG. 4 illustrates a further embodiment of a bank of permselective membrane cells wherein both the anolyte as well as the catholyte are serially transferred from cell to cell.

FIG. 5 illustrates an embodiment of the present invention employing series catholyte flow in permselective membrane cells employing a bipolar electrode arrangement; FIG. 6 illustrates a similar embodiment but employing a monopolar electrode arrangement.

FIG. 7 is an exploded view of a single cell unit of the type employed in the Examples.

DETAILED DESCRIPTION OF THE INVENTION AND OF THE PREFERRED EMBODIMENTS

Figure 1:
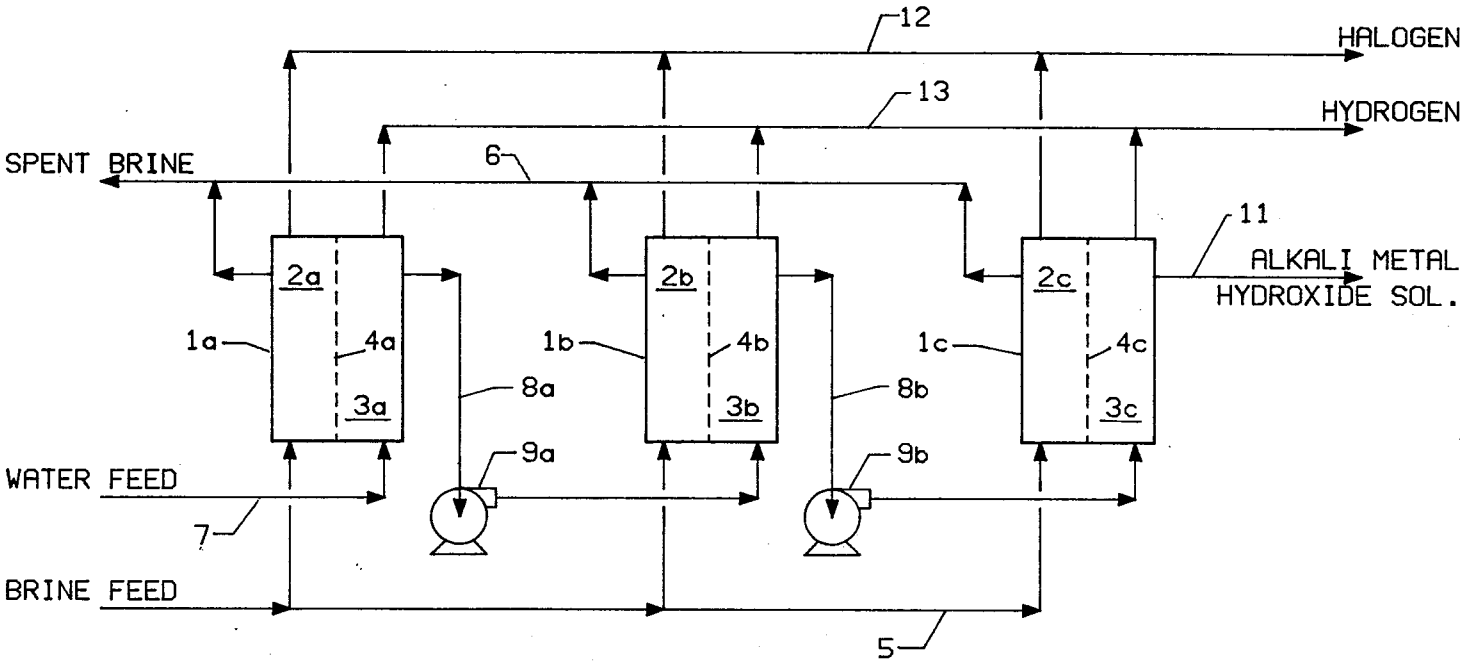
FIGS. 1 through 6 of the attached drawings are schematic flow diagrams of banks of cationic permselective membrane cells for electrolysis of alkali metal halide solutions embodying series catholyte flow as per the present invention.
Figure 2:
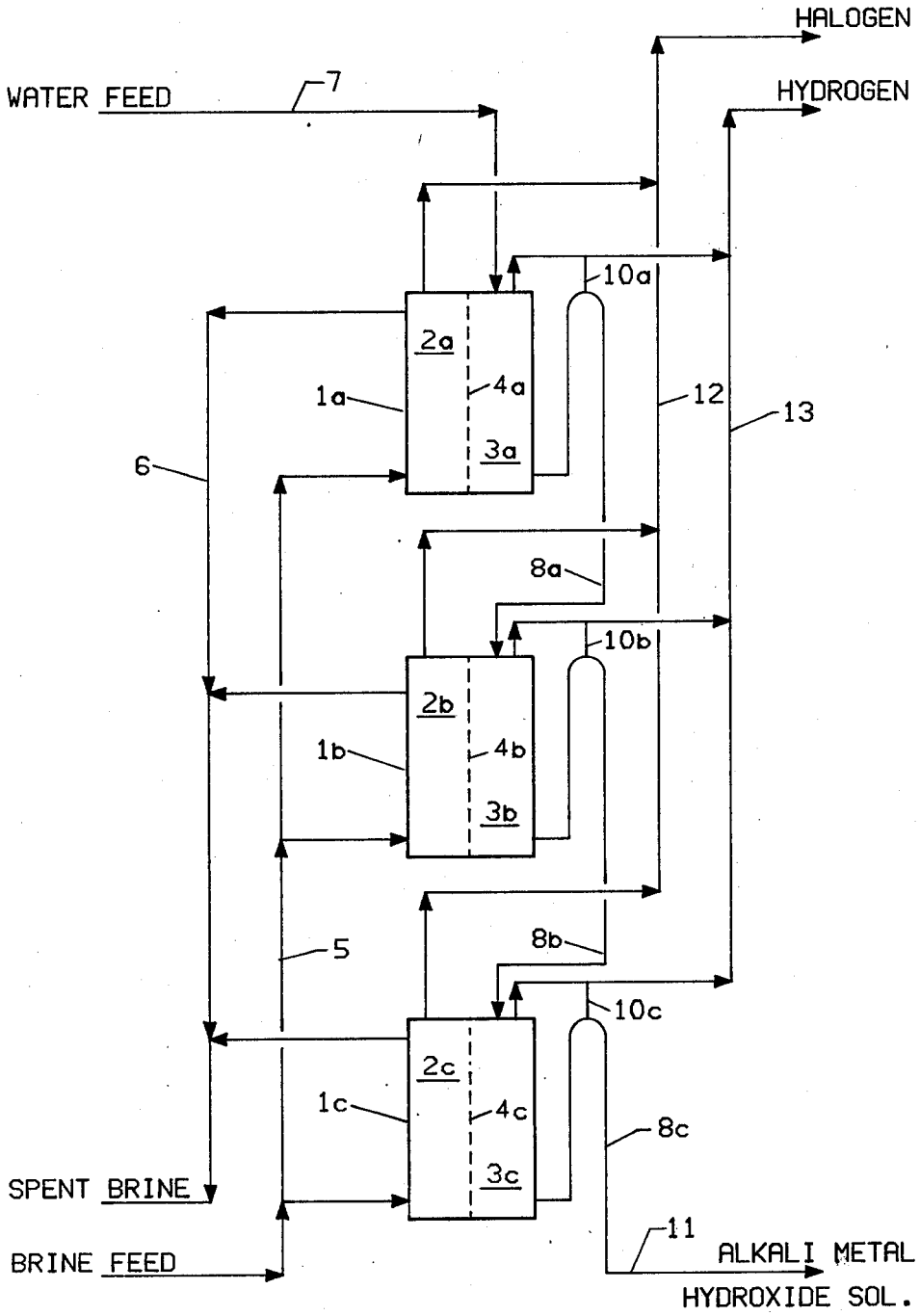

With reference to FIGS. 1 and 2 of the annexed drawings, both of which illustrate the series flow principle for the catholyte in cationic permselective membrane cells, there is shown in each figure a bank comprising three permselective membrane cells 1*a*, 1*b*, and 1*c*, each having an anolyte compartment 2*a*, 2*b*, and 2*c*, and a catholyte compartment 3*a*, 3*b*, and 3*c*, separated by cationic permselective membranes 4*a*, 4*b*, and 4*c*. Anodes and cathodes are not shown for the sake of simplicity. Brine of aqueous alkali metal halide solution is fed to the anode compartment of each cell by means of common header 5; spent brine is discharged from the anode compartment of each cell into common header 6. Water is fed by means of line 7 to the cathode compartment 3*a* of the first cell 1*a* in the bank only. Catholyte is then serially passed from cell to cell. In the embodiment illustrated by FIG. 1, this is accomplished by withdrawing catholyte from cathode compartment 3*a* of the first cell in the bank through line 8*a* and introducing it by means of pump 9*a* into the cathode compartment 3*b* of the second cell 1*b* in the bank, then withdrawing catholyte from cathode compartment 3*b* through line 8*b* and introducing it into catholyte compartment 3*c* of the third cell in the bank by means of pump 9*b*. Alkali metal hydroxide solution is discharged from catholyte compartment 3*c* of the third cell in the bank into product line 11. Diatomic halogen gas and hydrogen produced in the anode and cathode compartments of each cell are withdrawn through common headers 12 and 13, respectively. In the embodiment illustrated by FIG. 2, wherein series catholyte flow from cathode compartment to cathode compartment is effected by means of gravity, catholyte from cathode compartment 3*a* of the first cell in the series 1 flows by means of gravity through line 8*a* into cathode compartment 3*b* of the second cell in the series, then from cathode compartment 3*b* to cathode compartment 3*c* of the third cell in the series, to be withdrawn therefrom as alkali metal hydroxide solution product through line 11. The level of catholyte in each of the three catholyte compartments is maintained by seal loops 10*a*, 10*b* and 10*c*.

Figure 3:
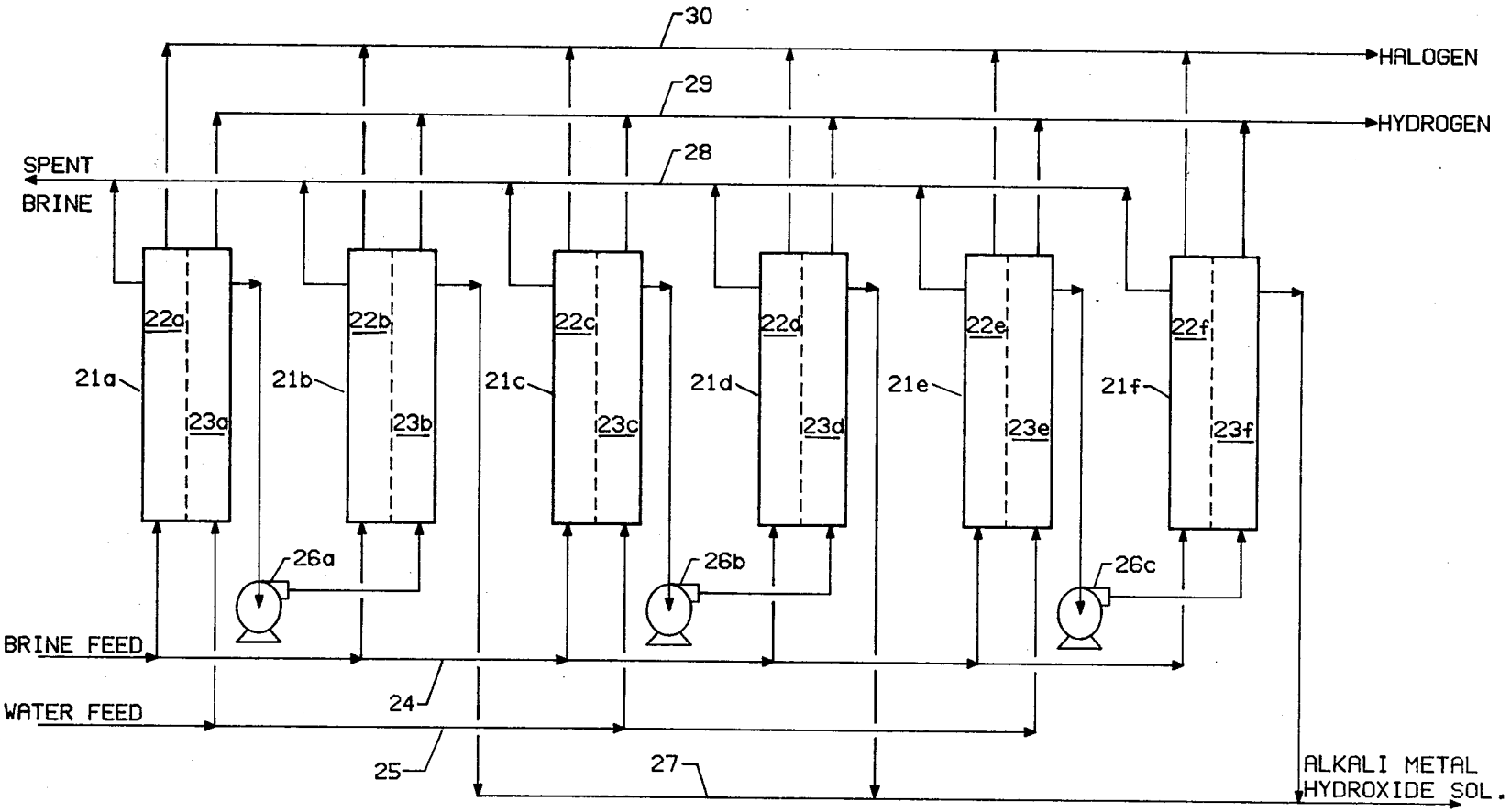

FIG. 3 illustrates another embodiment of the process and apparatus of the present invention employing series catholyte flow. FIG. 3 illustrates a bank of cationic permselective membrane cells comprised of six cells, 21*a* through 21*f*, employing series catholyte flow in paired cells, viz. cells 21a and 21b; 21c and 21d; and 21e and 21f. Alkali metal halide brine is fed through common header 24 to the anode compartments 22a through 22f of each of the cells in the bank in parallel, and spent brine is discharged from the anode compartments into common header 28. Water is fed to the cathode compartments of the first, third, and fifth cell in the bank, i.e., to cathode compartments 23a, 23c, and 23e. Catholyte from these cathode compartments is transferred by means of pumps 26a, 26b and 26c respectively into the cathode compartment of the next cell in the series, i.e. from cathode compartment 23a to cathode compartment 23b; from cathode compartment 23c to cathode compartment 23d; and from cathode compartment 23e to cathode compartment 23f. Alkali metal hydroxide solution product is discharged from cathode compartment 23b, 23d, and 23f to common header 27. Halogen and hydrogen are discharged from the anode and cathode compartments of each cell in the bank to common headers 30 and 29, respectively.

Figure 4:
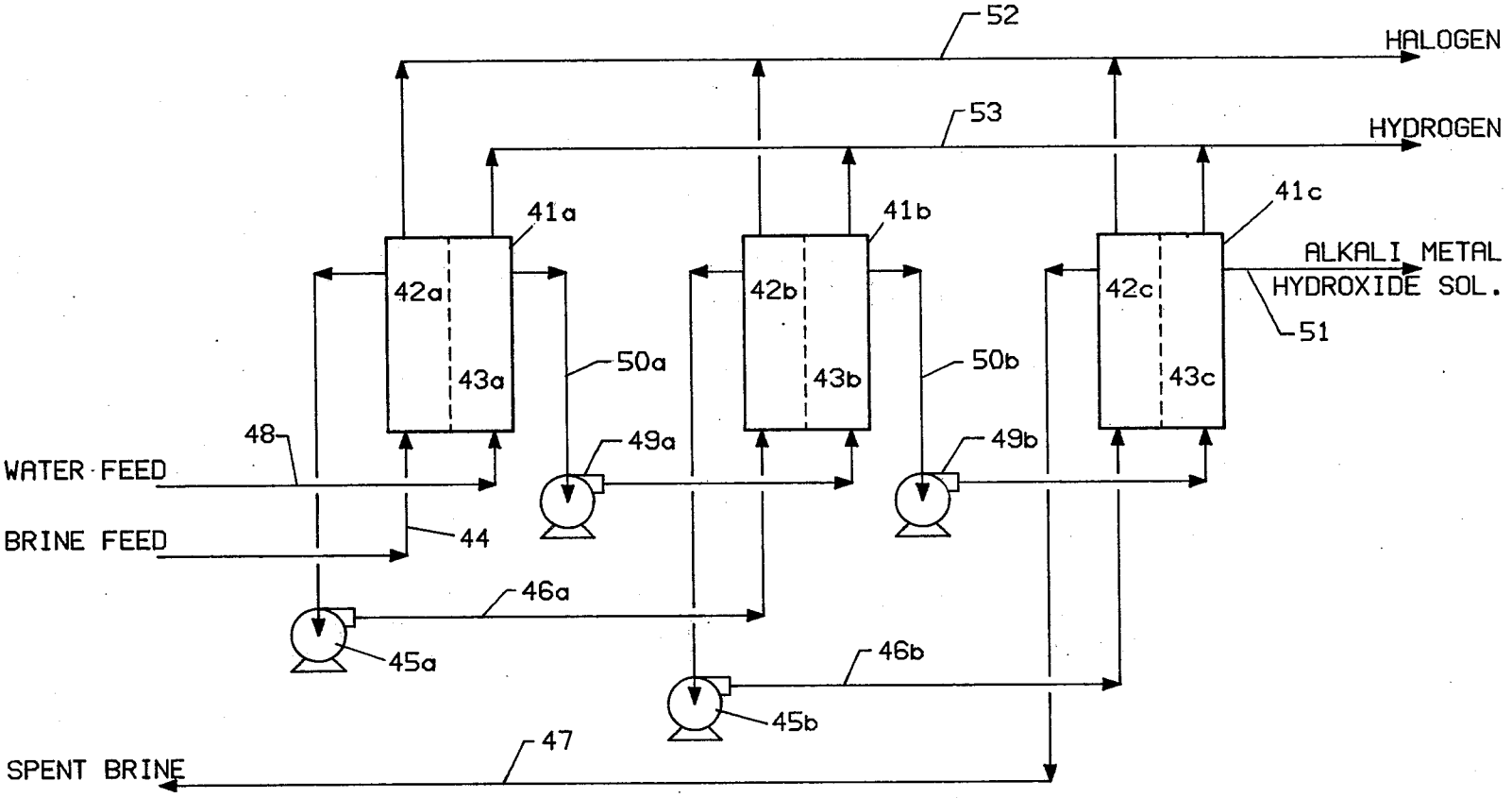

FIG. 4 of the drawings illustrates an embodiment of the present invention employing series flow for the anolyte as well as for the catholyte. FIG. 4 illustrates a bank of cationic permselective membrane cells comprising three cells 41a, 41b, and 41c, each having an anode compartment 42a, through 42c, and a cathode compartment 43a through 43c. Alkali metal halide brine is fed through line 44 to cathode compartment 42a of the first cell 41a in the bank, is withdrawn therefrom as by permitting it to overflow and is transferred by means of pump 45a via line 46a into cathode compartment 42b of the second cell in the bank, 41b. From anode compartment 42b the anolyte is transferred by means of pump 45b via line 46b to the anode compartment of the last cell in the bank, 42c, wherefrom the spent brine is discharged via line 47 to be resaturated with alkali metal halide. Water is fed via line 48 to cathode compartment 43a of the first cell in the bank. Catholyte from cathode compartment 43a is transferred to cathode compartment 43b of the second cell in the bank via line 50a by means of pump 49a. Catholyte from cathode compartment 43b is transferred by means of pump 49b via line 50b to the cathode compartment 43c of the last cell in the bank, wherefrom it is discharged as alkali metal hydroxide solution product via line 51. Halogen gas and hydrogen are discharged from each anode and cathode compartment to common headers 52 and 53, respectively.

Figure 5:
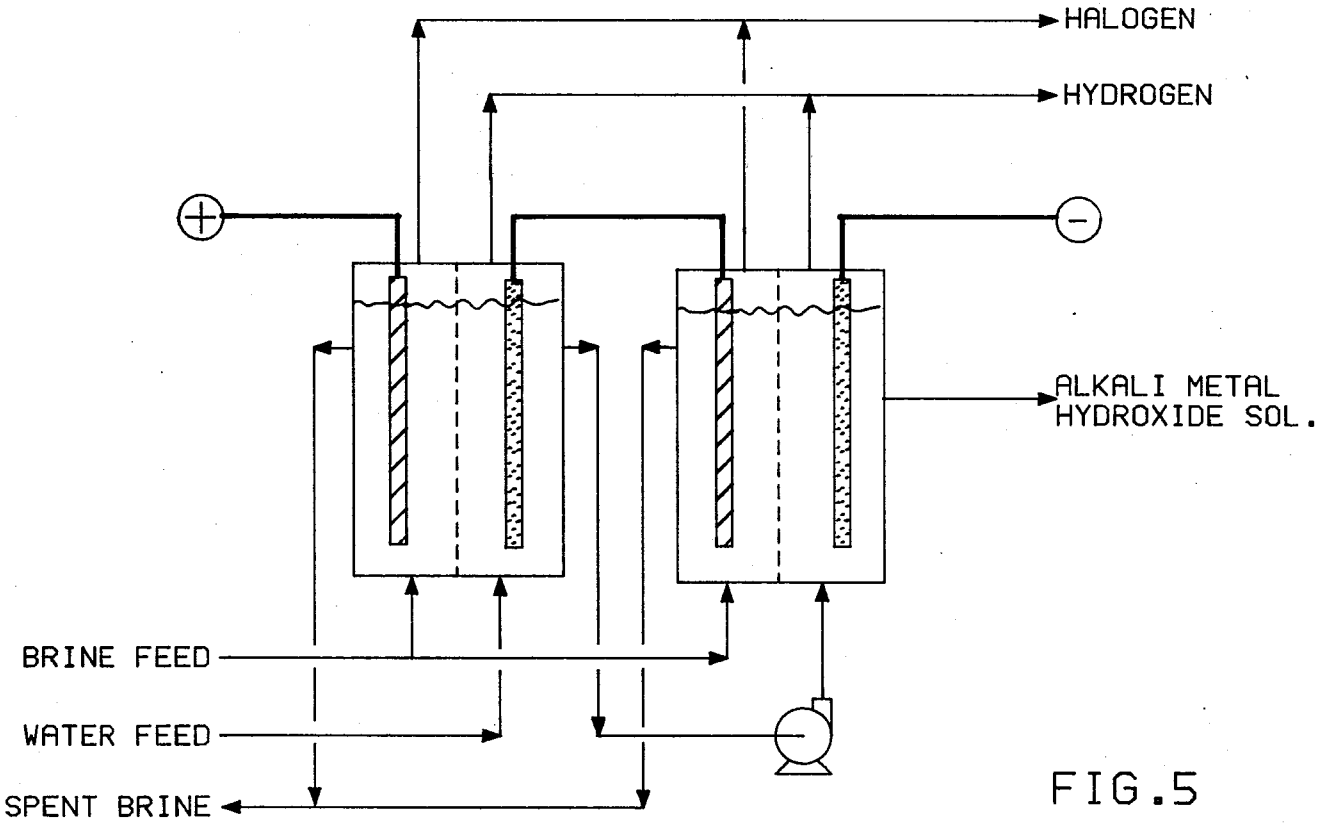
Figure 6:
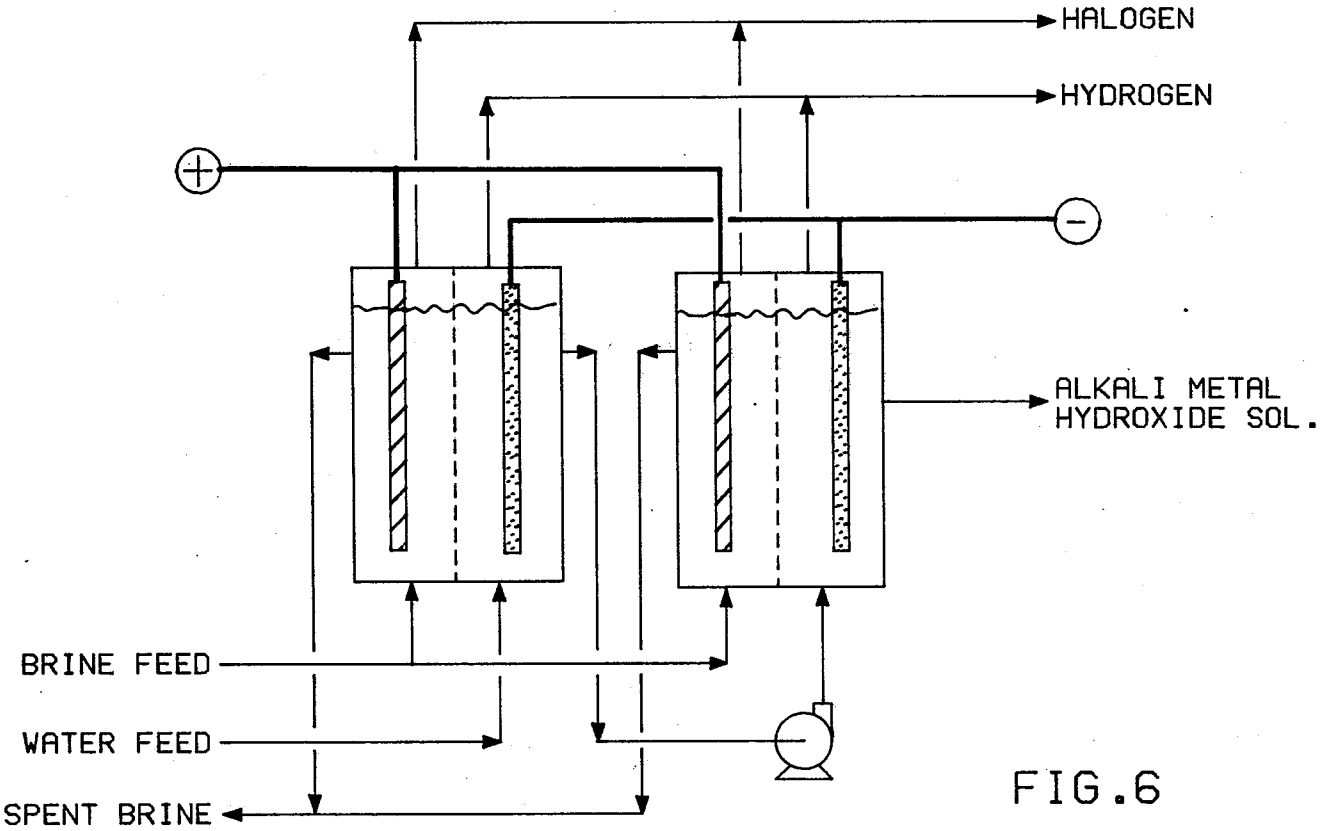

There are two distinct types of electrode arrangement which can be utilized in the operation of a bank of membrane cells, namely a bipolar arrangement, as illustrated by FIG. 5, and a monopolar arrangement, as illustrated by FIG. 6. In a monopolar arrangement all of the cathodes of the bank of cells are connected to common negative terminal, and all of the anodes are connected to a common positive terminal. Thus, the voltage potential across the common positive and negative terminal of the bank of cells is the same as that applied to each individual cell, assuming negligible line resistance. In a bipolar assembly, all the cells are connected electrically in series so that the cathode of each cell is connected directly to the anode of a succeeding cell except, of course, in the case of the first and the last cell in the bank. Thus, in a bipolar assembly the voltage potential across the terminals of the power supply is the sum of the individual cell voltages, again assuming negligible line resistance. The advantage of reduced overall power consumption obtainable by employing series catholyte flow in accordance with the present invention is in no way affected by the type of electrical circuitry utilized. Either the bipolar or the monopolar mode may be utilized. However, to minimize capital construction costs, the bipolar electrode assembly is preferred, since bipolar assembly permits the greatest simplicity in mechanical and electrical construction of a compact cell bank.

Cationic permselective membranes for use in electrolytic cells for making alkali metal hydroxide solution and diatomic halide gas from alkali metal halide brine are well known to those skilled in the art and are commercially available, for example, from DuPont under the trademark Nafion. Commercially available permselective membranes are usually formed of fluorosulfonic acid resin which, in order to improve their physical strength, may be laminated to a woven mesh or fabric formed from halocarbon polymers, such as polytetrafluoroethylene, for example, polytetrafluoroethylene fabric. Fabric reinforcement also increases the dimensional stability of the membranes. Long term maintenance of dimensional stability of such membranes in use is enhanced by providing a planar membrane surface, as is preferred. Cost of construction of membrane cells employing a planar membrane is minimized by providing a high membrane surface area relative to the cell volume. Consequently, a cell design incorporating anode and cathode compartments having relatively shallow cavities but relatively large width and height dimensions, so that the membrane interfacial area between the anode and cathode compartments will tend to be large in relation to total cell volume, is preferred. For commercial size cells, suitable ratios of membrane surface area to cell volume $(\text{in.})^{-1}$ may be in the order of about 1:4 to about 1:0.50, for example, the ratio of membrane surface area to cell volume tending to become smaller for cells with greater productive capacity.

Suitable materials of construction for the cell body include any material which is substantially inert to the raw materials fed to and the products produced within the cell, and include for example, inert plastics e.g. halocarbon polymers or polypropylene, optionally strengthened by inclusion of a suitable filler, such as fiber glass or mineral fiber.

The anodes and cathodes may be constructed of material ordinarily employed in the fabrication of membrane cells, for example, the anoe may be a so-called "Dimensionally Stable Anode", trademark of Electrode Corporation, comprising a titanium grid coated with a rare earth metal oxide coating. The cathode may, for example, be constructed of a mild steel grid. To aid in release of the gases generated on the surface of the anode and the cathode and to thereby minimize overvoltage effects, it is preferred to place the anodes in a vertical position, which dictates employment of a vertically mounted membrane.

Detailed design and construction of apparatus for carrying out the present invention is within the skills of an ordinarily skilled practioner versed in the art.

To obtain high solution conductivity, it is desirable to maintain the alkali metal halide concentration in the brine in the anode compartment at the highest possible level. Since, for reasons discussed above, even a relatively high concentration of halide ions in the anolyte will not lead to significant halide contamination of the hydroxide product, this poses no particular problem from the standpoint of product purity. A high concentration of dissolved halide can be maintained in the anolyte simply by recirculating the anolyte feed through the anode compartment at a relatively high mass flow rate, returning the anolyte to a resaturater wherein it dissolves additional alkali metal halide, and then recirculating the reconcentrated anolyte to the anode compartment. Turbulent mixing of the anolyte as a consequence of a high rate of recirculation through the anode compartment also serves to reduce the overvoltage effect caused by accumulation of gaseous halogen on the surface of the anode, thereby increasing overall operating efficiency. Since a low alkali metal halide depletion rate is desired, it is preferred to employ parallel anolyte flow. If series anolyte flow is employed, the alkali halide concentration is incrementally reduced from anode compartment to anode compartment, and the overall average alkali metal halide concentration for all the anode compartments in the bank of cells will be lower than obtainable with parallel anolyte flow. However, the advantage obtained in higher current efficiency from use of series catholyte flow in accordance with the present invention is in no way dependent upon the type of flow employed for the anolyte, whether series or parallel. For reasons given above, parallel anolyte flow in conjunction with series catholyte flow is a preferred mode of flow arrangement in order to obtain optimum average cell power efficiency.

The means by which series catholyte flow is effected are not critical for purposes of the present invention. Care must be taken, however, to approximately equalize the pressure between the anode and cathode compartment because of the limited physical strength of the membrane.

The apparatus and process of the present invention are particularly suited for making sodium and potassium hydroxide, chlorine and hydrogen from sodium or potassium chloride.

The following Examples further illustrate the present invention and sets forth the best mode presently contemplated for its practice.

EXAMPLES 1-7

Figure 7:
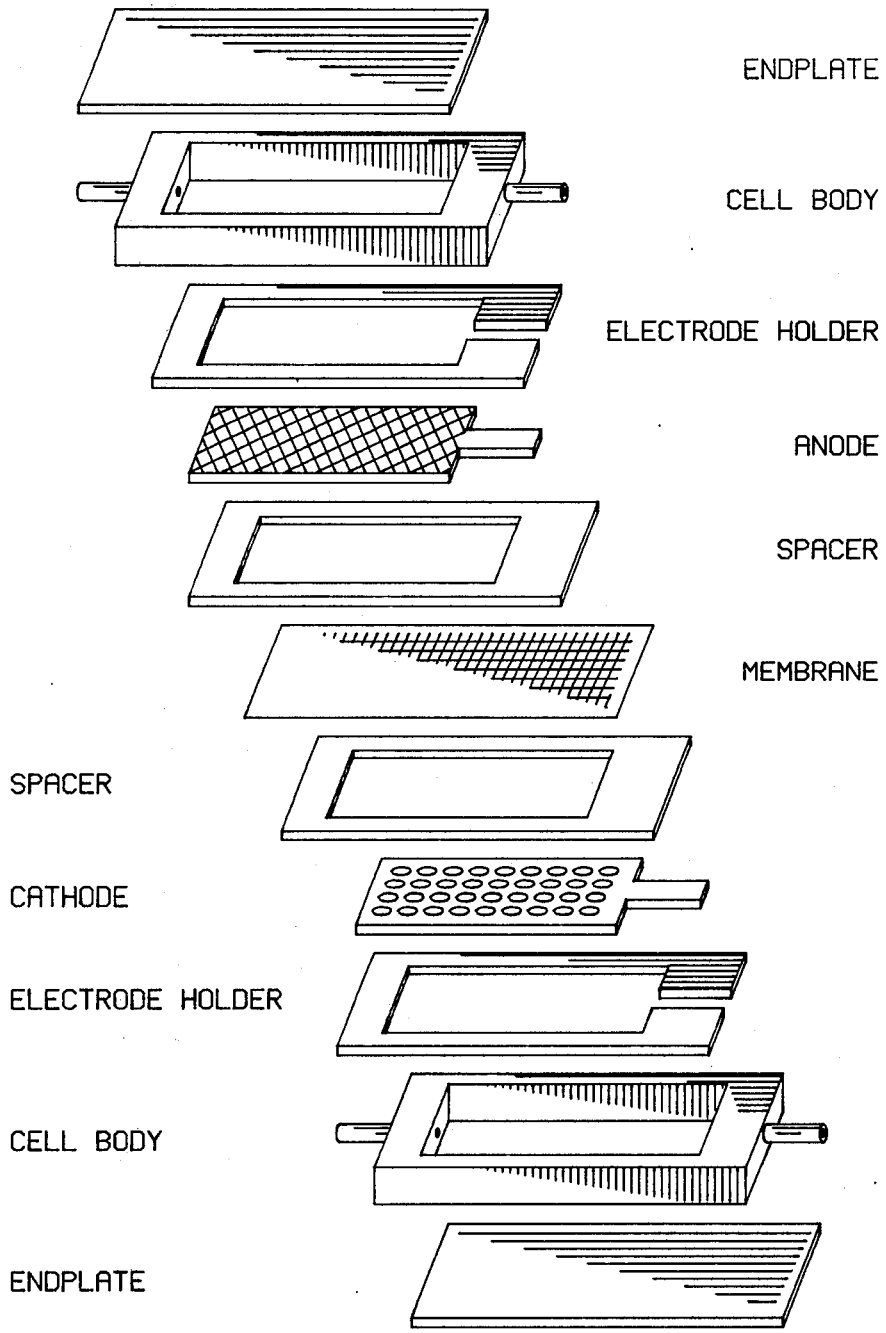
FIG. 7 is an exploded isometric view of a single cell unit suitable for incorporation into a bank of cells for practice of the present invention.

Examples 1 through 7 illustrate electrolysis of sodium chloride brine to make sodium hydroxide solution, chlorine and hydrogen in a bank of three cationic permselective membrane cells employing parallel anolyte flow and series catholyte flow. The electrolyte flow in the bank of cells is as schematically shown in FIGS. 1 and 2 of the drawings. A bipolar electrode arrangement is employed of the type illustrated by FIG. 5. The cells employed are constructed as illustrated by FIG. 7, which provides an exploded isometric view of the principal components of a single cell in the bank. Not shown in FIG. 7 are the gaskets between the individual components; clamping means for holding the components together; lines for feeding brine and water and for withdrawing spent brine and caustic product; inter-cell connections for series catholyte flow; as well as the electrical connections. The anode employed is a so called "Dimensionally Stable Anode" supplied by Electrode Corporation and constructed of titanium coated with rare earth metal oxide coating. The cathode is constructed of a mild steel grid. The membrane is a cationic permselective membrane supplied by DuPont under the trademark Nafion. The current density employed is 2500 Amps. per square meter. The pressure within the cell compartments is maintained at about 7 inches $H_2O$ in the anode compartment, and about 1 inch $H_2O$ in the cathode compartment to prevent leakage, which could result from a failure of the membrane, of hydrogen formed at the cathode into the chlorine product and thus avoid explosive conditions. Each example is run for a total time period of about 8 hours. Operating conditions and results obtained are summarized in Table I, below.

Table 1

| | Example 1 | 2 | 3 | 4 | 5 | 6 | 7 |
|---|---|---|---|---|---|---|---|
| Operating Conditions | | | | | | | |
| Feed Brine Conc. (grams/liter) | 322 | 322 | 321 | 318 | 312 | 309 | 314 |
| Brine Depletion Rate (%) | 10.9 | 12.0 | 12.1 | 9.9 | 10.5 | 11.7 | 9.4 |
| Avg. Cell Temp. (° C) | 81 | 82 | 81 | 83 | 83 | 84 | 85 |
| E.M.F. Volts Applied | | | | | | | |
| Cell #1 (a) | 4.1 | 4.2 | 4.3 | 4.2 | 4.2 | 4.0 | 4.0 |
| Cell #2 (b) | 3.7 | 3.9 | 4.0 | 3.8 | 3.8 | 3.7 | 3.7 |
| Cell #3 (c) | 4.1 | 4.4 | 4.6 | 4.3 | 4.4 | 4.4 | 4.2 |
| Total (a+b+c) | 11.9 | 12.5 | 12.9 | 12.3 | 12.4 | 12.1 | 11.9 |
| Average $\frac{(a+b+c)}{3}$ | 4.0 | 4.2 | 4.3 | 4.1 | 4.1 | 4.0 | 4.0 |
| Cell Efficiencies (Basis NaOH Produced) | | | | | | | |
| Voltage Eff. (%) | 56.5 | 53.4 | 51.9 | 54.7 | 53.9 | 55.5 | 55.9 |
| Current Eff. (%) | 90.0 | 93.4 | 89.7 | 90.0 | 91.6 | 83.2 | 83.1 |
| Power Eff. (%) | 50.0 | 49.9 | 46.5 | 49.2 | 49.4 | 46.1 | 46.5 |
| NaOH Concentration (wt. %) | | | | | | | |
| Cell #1 | 5.9 | 6.0 | 4.7 | 4.6 | 4.5 | 8.2 | 8.8 |
| Cell #2 | 10.1 | 10.1 | 8.1 | 7.7 | 7.5 | 13.2 | 14.3 |
| Cell #3 | 13.3 | 13.7 | 11.1 | 10.9 | 10.7 | 17.2 | 18.3 |
| Average | 9.8 | 9.9 | 8.0 | 7.7 | 7.6 | 12.9 | 13.8 |
| Power Consumption | | | | | | | |
| KWh/ton NaOH | 2,670 | 2,720 | 2,910 | 2,750 | 2,750 | 2,940 | 2,920 |

COMPARATIVE TEST

Equipment employed and operating conditions, except as otherwise stated below, are as in Examples 1 through 7. However, in the Comparative Test there is employed parallel anolyte flow as well as parallel catholyte flow. That is to say, sodium chloride brine is fed to the anode compartment of each cell in the bank; water is fed to the cathode compartment of each cell in the bank, and sodium hydroxide solution product is withdrawn from the cathode compartment of each cell in the bank. Results for the comparative test comprise the average results or two tests, one of about 3 hours duration, the other of about 8 hours duration. Other operating conditions and results obtained are summarized in Table II below.

Table II

| | Comparative Example |
|---|---|
| Operating Conditions | |
| Feed Brine Conc. (grams/liter) | 315 |
| Brine Depletion Rate (%) | 7.2 |
| Avg. Cell Temp. (° C) | 86 |
| E.M.F. Volts Applied | |
| Cell #1 (a) | 3.9 |
| Cell #2 (b) | 3.7 |
| Cell #3 (c) | 3.7 |
| Total (a+b+c) | 11.3 |
| Average $\frac{(a+b+c)}{3}$ | 3.8 |
| Cell Efficiencies (Basis NaOH produced) | |
| Voltage Eff. (%) | 59.0 |
| Current Eff. (%) | 76.2 |
| Power Eff. (%) | 45.0 |
| NaOH Concentration (wt.%) | |
| Cell #1 | 18.4 |
| Cell #2 | 18.4 |
| Cell #3 | 17.4 |
| Average | 18.1 |
| Power Consumption | |
| KWh/ton NaOH | 3,020 |

The current efficiency of 76.2% for the comparative test employing parallel catholyte flow compares with a current efficiency of 83.2 and 83.1% for examples 6 and 7 employing series catholyte flow at approximately the same final NaOH concentration.

Since various changes and modifications may be made in the invention without departing from the spirit and essential characteristics thereof, it is intended that all matter contained in the above description shall be interpreted as illustrative only, the invention being limited only by the scope of the appended claims.

We claim:

1. In a bank of a plurality of cationic permselective membrane cells for electrolysis of aqueous alkali metal halide solution to form alkali metal hydroxide and diatomic halide gas, each cell comprising;
   - a housing;
   - an anode and a cathode located within the housing;
   - a cationic permselective membrane separating the anode and the cathode and dividing the housing into an anode compartment and a cathode compartment;
   - means for feeding enriched and for withdrawing partially depleted aqueous alkali metal halide solution to and from the anode compartment of each cell in the bank;
   - means for feeding water or aqueous alkali metal hydroxide solution to the cathode compartment and for withdrawing aqueous alkali metal hydroxide solution from the cathode compartment of each cell in the bank; the improvement which comprises provision of:
   - means for transferring catholyte serially from the cathode compartment of one or more preceding cells to the cathode compartment of one or more succeeding cells in the bank.

2. The improvement of claim 1 wherein the aqueous alkali metal halide solution is an aqueous sodium chloride solution, wherein the alkali metal hydroxide is sodium hydroxide and wherein the diatomic halide gas is chlorine.

3. The improvement of claim 1 wherein the anodes and cathodes are arranged in bipolar mode.

4. The improvement of claim 1 wherein the anodes and cathodes are arranged in monopolar mode.

5. The improvement of claim 1 providing means for feeding water or weak alkali metal hydroxide solution to the cathode compartment of the first cell in the bank, means for tranferring the catholyte serially from the cathode compartment of a preceding cell to the cathode compartment of a succeeding cell in the bank, and withdrawing alkali metal hydroxide solution from the cathode compartment of one or more succeeding cells in the bank.

6. The improvement of claim 5 wherein the aqueous alkali metal halide solution is an aqueous sodium chloride solution, wherein the alkali metal hydroxide is sodium hydroxide, and wherein the diatomic halide gas is chlorine.

7. The improvement of claim 6 wherein the electrodes are arranged in bipolar mode.

8. The improvement of claim 6 wherein the electrodes are arranged in monopolar mode.

9. In the process of making aqueous alkali metal hydroxide solution and diatomic halide gas by electrolysis of aqueous alkali metal halide solution in a bank of a plurality of cationic permselective membrane cells, involving feeding enriched and withdrawing partially depleted aqueous alkali metal halide solution to and from the anode compartment of each cell, and feeding water or aqueous alkali metal hydroxide solution to and withdrawing catholyte comprising aqueous alkali metal hydroxide solution from the cathode compartment of each cell, the improvement which comprises transferring catholyte serially from the cathode compartment of one or more preceding cells to the cathode compartment of one or more succeeding cells in the bank.

10. The improvement of claim 9 wherein the aqueous alkali metal halide solution is an aqueous sodium chloride solution, wherein the alkali metal hydroxide solution is sodium hydroxide solution, and wherein the diatomic halide gas is chlorine.

11. The improvement of claim 9 comprising feeding water or weak alkali metal hydroxide solution to the cathode compartment of the first cell in the bank, transferring the catholyte serially from the cathode compartment of a preceding cell to the cathode compartment of a succeeding cell in the bank, and withdrawing alkali metal hydroxide solution from the cathode compartment of one or more succeeding cells in the bank.

12. The improvement of claim 11 wherein the aqueous alkali metal halide solution is an aqueous sodium chloride solution, wherein the alkali metal hydroxide solution is a sodium hydroxide solution, and wherein the diatomic halide gas is chlorine.

13. The improvement of claim 9 comprising feeding water to the cathode compartment of the first cell in the bank, transferring the catholyte serially from the cathode compartment of each preceding cell to the cathode compartment of the next succeeding cell, and withdrawing alkali metal hydroxide solution as product from the last cell in the bank.

14. The improvement of claim 13 wherein the aqueous alkali metal halide solution is an aqueous sodium chloride solution, wherein the alkali metal hydroxide solution is a sodium hydroxide solution, and wherein the diatomic halogen gas is chlorine.

15. The improvement of claim 13 wherein the aqueous alkali metal halide solution is an aqueous potassium chloride solution, wherein the alkali metal hydroxide solution is a potassium hydroxide solution, and wherein the diatomic halogen gas is chlorine.

* * * * *